United States Patent [19]

Miyashige et al.

[11] Patent Number: 4,621,711

[45] Date of Patent: Nov. 11, 1986

[54] PRESSURE OIL LINE SYSTEM FOR A FORK LIFT TRUCK

[75] Inventors: Toshun Miyashige, Takahama; Masataka Sakata, Handa; Masakazu Asano, Ohbu, all of Japan

[73] Assignee: Kabushiki Kaisha Toyoda Jidoshokki Seisakusho, Kariya, Japan

[21] Appl. No.: 679,007

[22] Filed: Dec. 6, 1984

[30] Foreign Application Priority Data

Dec. 16, 1983 [JP] Japan ..... 58-194635[U]

[51] Int. Cl.[4] ..... B66B 9/20

[52] U.S. Cl. ..... 187/9 E; 414/631

[58] Field of Search ..... 187/9 E, 9 R; 414/631, 414/785, 628, 629, 630, 618, 592; 254/89 H, 93 R, 277

[56] References Cited

U.S. PATENT DOCUMENTS

| | | | |
|---|---|---|---|
| 2,513,928 | 7/1950 | Frischmann | 187/9 E |
| 2,987,140 | 6/1961 | Olson | 187/9 E |
| 3,203,568 | 8/1965 | Quayle | 187/9 R |
| 3,777,853 | 12/1973 | Miller | 187/9 R |
| 3,894,616 | 7/1975 | Kawanishi et al. | 187/9 E |
| 4,261,438 | 4/1981 | Olson | 187/9 E |
| 4,493,397 | 1/1985 | Maes | 187/9 E |
| 4,503,936 | 3/1985 | Rice | 187/9 E |

FOREIGN PATENT DOCUMENTS

| | | |
|---|---|---|
| 53-46705 | 11/1978 | Japan . |
| 2096571 | 10/1982 | United Kingdom . |

*Primary Examiner*—Joseph J. Rolla
*Assistant Examiner*—Kenneth Noland
*Attorney, Agent, or Firm*—Wenderoth, Lind & Ponack

[57] ABSTRACT

The present invention provides a fork lift truck in which a pair of hose pulley wheels, lesser in diameter than a pair of chain wheels, are mounted rotatably below these chain wheels about which are wound a pair of lifting chains, and a pair of oil hoses belonging to a hydraulically attachment or unit are wound about these hose pulley wheels so as to be disposed inside said lifting chains and overlapped therewith in the longitudinal direction of the truck. In this manner, the oil hoses of the driving attachment are hidden behind the lifting chains when seen in the longitudinal direction so that the hoses do not directly obstruct the forward view of the driver.

3 Claims, 4 Drawing Figures

PRESSURE OIL LINE SYSTEM FOR A FORK LIFT TRUCK

BACKGROUND OF THE INVENTION

This invention relates to a hydraulic line system connection for connecting a control valve on the chassis of a fork lift truck with a driving attachment or unit fitted to a lifting bracket of the truck.

PRIOR ART

In the conventional mast assemblies for fork lift trucks, the hydraulic line system for feeding pressure oil to the driving attachment is placed along the outer or inner sides of the masts. In both cases, the oil line system proves to be a hindrance to the forward view of the driver. Various attempts have been made in order to improve the forward view as by placing a number of oil hoses in an overlapping relation with one another in the front and rear directions of the truck for minimizing the space or area occupied by these oil hoses in the widthwise direction of the truck. Such a solution is effective in improving the forward view as compared to the case of placing the oil hoses on both the left and right sides. However, in this case, the hoses are not sufficiently protected against injury caused by falling objects, especially when the hoses are placed on the outer sides of the masts.

SUMMARY OF THE INVENTION

It is a principal object of the present invention to obviate the above described inconvenience and to provide a hydraulic line system for an attachment provided on the fork lift truck which is effective in improving the forward view and to in protecting the line system against possible injury from falling objects.

In general terms, the present invention resides in a hydraulic line system connection for a fork lift truck characterized in that hose pulley means are mounted directly below rotatable chain wheel means about which are placed lifting chain means adapted for raising and lowering a lifting bracket as a result of the operation of lifting cylinder means, the hose pulley means being also rotatable and lesser in diameter than the chain wheel means, and in that hose means are provided inside the lifting chain means and so as to be overlapped therewith in the longitudinal direction of the fork lift truck, whereby the hose means are hidden behind the lifting chain means in the longitudinal direction of the truck so as not to directly obstruct the forward view of the driver.

BRIEF DESCRIPTION OF THE DRAWINGS

In the accompanying drawings illustrating a preferred embodiment of the fork lift truck of the present invention.

DESCRIPTION OF THE PREFERRED EMBODIMENT

A fork lift truck according to a preferred embodiment of the present invention is now explained by referring to the accompanying drawings.

Figure 1:
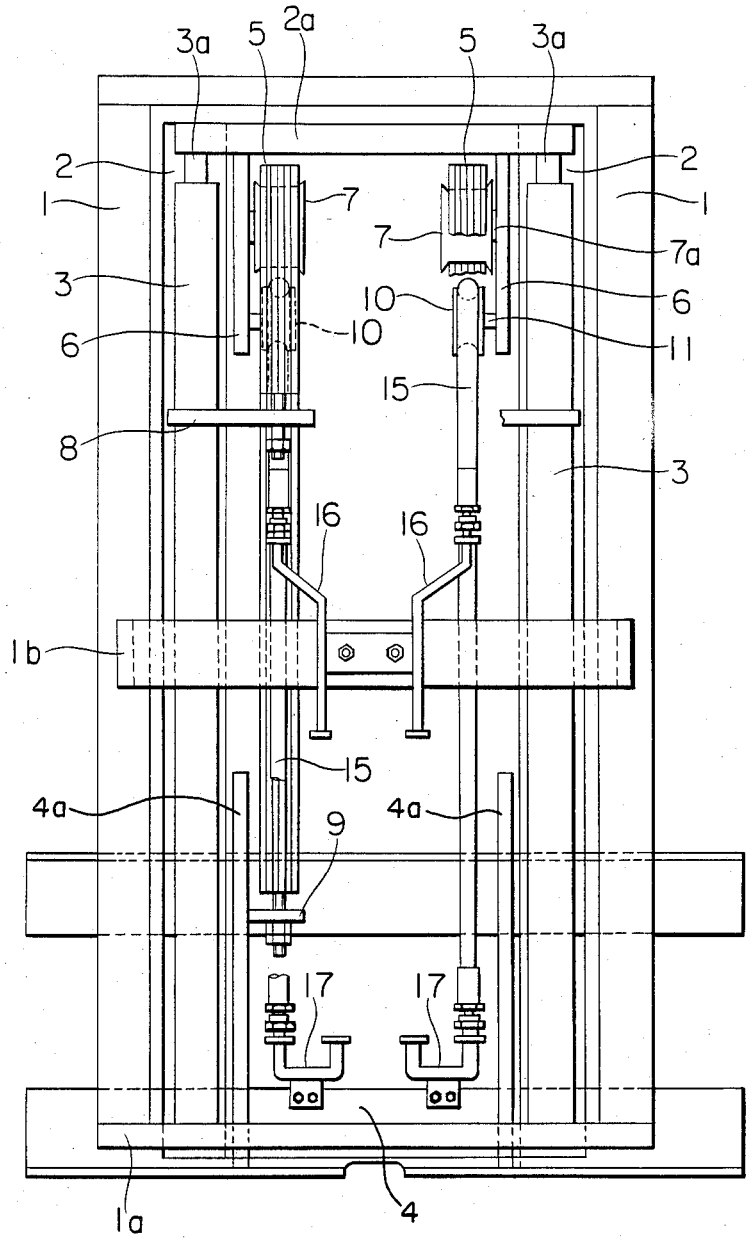
FIG. 1 is a front view of the fork lift truck as seen by the driver.
Figure 2:
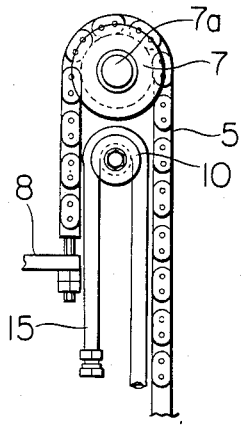
FIG. 2 is a partial side elevation thereof.
Figure 3:
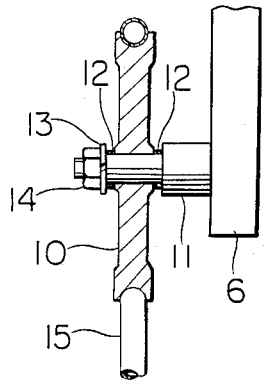
FIG. 3 is a partial sectional view of the hose pulley wheel.
Figure 4:
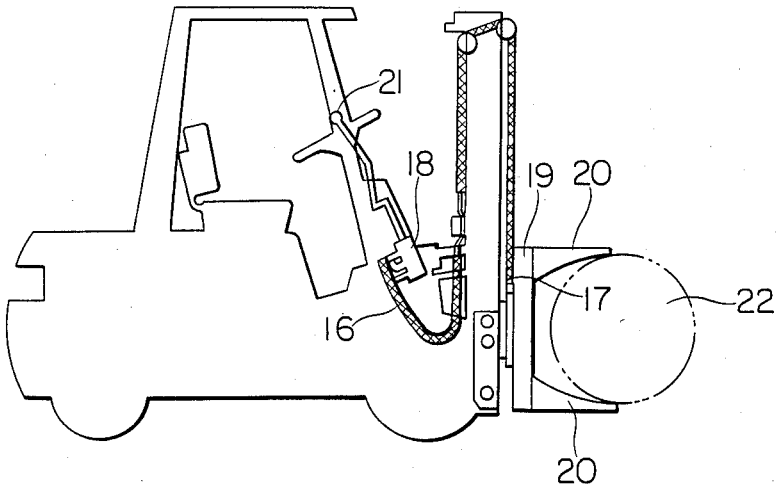
FIG. 4 is a side view of the lift truck when the oil line system of the present invention is attached.

In these drawings, a mast assembly is described wherein the numeral 1 designates a pair of outer masts, that is, a left side outer mast and a right side outer mast, and the numeral 2 a pair of inner masts, that is, a left side inner mast and a right side inner mast. The numeral 3 designates a pair of hydraulic lifting cylinders, that is, a left side hydraulic lifting cylinder and a right side hydraulic lifting cylinder, that are mounted upright on a lower cross beam 1*a* of the outer masts 1 on the rear side of the masts, and having piston rods 3*a* securely mounted to an upper tie beam 2*a* of the inner masts 2. The numeral 4 designates a lifting bracket that is suspended by left and right side lift chains 5 that are mounted inwardly of the lifting cylinders 3 when seen in FIG. 1. In this manner, the lifting bracket 4 can be raised and lowered along the inner.masts 2. These lifting chains 5 are placed about and depend from chain wheel pulleys 7 rotatably mounted via chain wheel shafts 7*a* on left side and right side wheel brackets 6 in turn securely attached to the lower side of the upper tie beam 2*a*. The chain wheel shafts 7*a* are securely mounted to these depending wheel brackets 6. Each lifting chain 5 is fixedly mounted at one end to the associated lifting cylinder 3 via a fixed bracket 8 (FIG. 2) and at the other end at a bracket 4*a*, attached to the lifting bracket 4, via a fixed lug 9.

Directly below these chain wheels 7, there are respectively mounted hose pulley wheels 10 each being lesser in diameter than the associated chain wheel 7. These pulley wheels 10 are mounted on pulley wheel supporting stud shafts 11 securely mounted to the wheel brackets 6 in parallel to the chain wheel shafts 7*a*. The pulley wheels are engaged from both sides by collars 12, 12 for rotation about the stud shafts 11. Each pulley wheel 10 is prevented from extricating from the associated stud shaft by a washer 13 held in position by a nut 14 attached to the end part of the stud shaft 11. An oil hose 15 of a hydraulically driven attachment is placed around and depends from each hose pulley wheel 10 in such a manner that the hose is suspended freely along the inside of the associated lifting chain 5 and vertically aligned with the lifting chain 5 in the front and rear directions direction of the fork lift truck. Each hose 15 is connected at one end to a bent tube 16 securely mounted to the rear side of a fixed middle cross beam 1*b* of the outer masts 1, 1 and at the other end to another bent tube 17 securely mounted to the rear side of the lifting bracket 4. The bent tubes 16 adjacent to the middle cross beam are connected to a control valve 18, while the bent tubes 17 adjacent to the lifting bracket 4 are connected to a hydraulically driven attachment or unit 19. The hydraulically driven unit 19 is provided with a pair of vertically movable arm members or prongs 20, 20. By operating a control lever 21 operatively associated with the control valve 18, oil under pressure may be supplied through these oil hoses 15 to the driving unit 19 for actuating the prongs 20 and thereby gripping an object 22.

It will be appreciated that, in accordance with the present embodiment, the oil hoses 15 of the driving unit are mounted along the inner sides of the lifting chains 5 so as to be vertically aligned therewith in the front and rear directions of the fork lift truck. The hoses 15 which, in the conventional devices, are mounted to obstruct the forward view of the driver, may now be hidden by the lifting chains 5 so that the forward view of the driver is correspondingly improved. Moreover, the hoses 15 may be protected from injury by projecting parts or by objects dropped accidentally during the material handling operation.

It is to be noted that the present invention is not limited to the above embodiment, but may comprise a number of modifications. For example, the present invention may be applied to a fork lift truck provided with a lifting cylinder between the masts or with three stage masts. The hose pulley wheels 10 may also be slightly movable in the fixed mounting position thereof for adjusting the tautness of the oil hoses 15.

From the foregoing it is seen that the present invention provides an arrangement whereby oil hoses may be mounted in a manner which does not obstruct the forward view of the driver thus contributing to the operational safety and efficiency of the fork lift and at least a portion of the lifting chain is mounted just in front of the hose for protecting the hose from injury by protuberances or falling objects thereby preventing accidents caused by hose rupture.

What is claimed is:

1. In a fork lift truck having a mast assembly made up of inner and outer masts, a lower cross beam mounted between the outer masts, an upper tie beam mounted between the inner masts, at least one lifting cylinder mounted on the lower cross beam and having a piston rod attached to the upper tie beam, chain means for raising and lowering a lifting bracket and a hydraulically driven unit carried by the lifting bracket, the improvement comprising a pressure oil line system comprising:

hose means for supplying oil under pressure to the hydraulically driven unit;

at least one wheel bracket connected to the upper tie beam;

hose pulley means, mounted on said at least one wheel bracket, for rotatably supporting said hose means;

chain wheel means, mounted on said at least one wheel bracket at a position between the upper tie beam and said hose pulley means, for rotatably supporting the chain means;

said chain wheel means including at least one chain wheel pulley having a first diameter and said hose pulley means including at least one hose wheel pulley having a second diameter which is smaller than said first diameter, said at least one chain wheel pulley being vertically aligned with said at least one hose wheel pulley and the chain means being vertically aligned with and on either side of at least a portion of said hose means, whereby said hose means and said hose pulley means are hidden by the chain means which improves the forward view of a driver of the fork lift.

2. A forklift truck comprising:

a vehicle body;

a mast assembly mounted on a front end of said vehicle body;

said mast assembly including a pair of spaced apart outer masts and a pair of spaced apart inner masts, said inner and outer masts having upper and lower ends, an upper tie beam attached to said upper ends of said inner masts, a lower cross beam attached to said lower ends of said outer masts, a pair of spaced apart lifting cylinders mounted on said lower cross beam, each lifting cylinder having a slidable piston attached at an upper end thereof to said upper tie beam, a lifting bracket, means for raising and lowering said lifting bracket and a hydraulically driven unit mounted on said lifting bracket;

said raising and lowering means including a pair of spaced apart wheel brackets attached at upper ends thereof to said upper tie beam, a chain wheel pulley rotatably mounted on each of said wheel brackets at a position near said upper tie beam, a chain having opposite ends vertically depending from each said chain wheel pulley, each of said opposite ends being offset from each other and aligned in a vertical plane and inner sides of said chain forming a space therebetween, one of said opposite ends being connected to said lifting bracket and the other of said opposite ends being connected to a stationary part of said mast assembly for raising and lowering said lifting bracket when said slidable piston raises and lowers said upper tie beam;

a pressure oil line system including a small diameter hose wheel pulley rotatably mounted on a lower end of each of said wheel brackets, each said hose wheel pulley being vertically aligned with a respective one of said chain wheel pulleys, a hose having opposite ends vertically depending from each of said hose wheel pulleys, one of said opposite hose ends adapted to be connected to a source of oil under pressure and the other of said opposite hose ends connected to said hydraulically driven unit, each said hose being contained within said space defined by said inner sides of one of said chains whereby at least a portion of said hose wheel pulleys and said hoses are hidden from view by said chains and do not obstruct the view of a driver of said fork lift truck.

3. The forklift truck of claim 2, wherein said hydraulically driven unit includes a pair of movable arm members, control valve means mounted on said vehicle body connected to said one end of said hoses for actuating said hydraulically driven unit and control lever means mounted on said vehicle for actuating said control valve means, whereby said control lever means is operable to supply oil under pressure through said control valve means to said hydraulically driven unit for opening and closing said movable arm members to grip or release an object.

* * * * *